US009361897B2

(12) United States Patent
Yoo et al.

(10) Patent No.: US 9,361,897 B2
(45) Date of Patent: Jun. 7, 2016

(54) DEVICE AND METHOD FOR ENCODING AND DECODING MULTICHANNEL SIGNAL

(75) Inventors: Jae Hyoun Yoo, Daejeon (KR); Tae Jin Lee, Daejeon (KR); Kyeong Ok Kang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 98 days.

(21) Appl. No.: 14/369,770

(22) PCT Filed: Feb. 29, 2012

(86) PCT No.: PCT/KR2012/001547

§ 371 (c)(1),
(2), (4) Date: Jun. 30, 2014

(87) PCT Pub. No.: WO2013/103175

PCT Pub. Date: Jul. 11, 2013

(65) Prior Publication Data

US 2014/0372130 A1 Dec. 18, 2014

(30) Foreign Application Priority Data

Jan. 2, 2012 (KR) ..... 10-2012-0000241

(51) Int. Cl.
*G10L 19/008* (2013.01)

(52) U.S. Cl.
CPC ..... *G10L 19/008* (2013.01)

(58) Field of Classification Search
CPC ... G10L 19/008; H04S 2420/03; H04S 3/002; H04H 20/62; H04H 20/76
USPC ..... 704/500; 381/22, 23; 700/94; 725/28, 725/30, 25, 34
See application file for complete search history.

(56) References Cited

U.S. PATENT DOCUMENTS

| | | | | |
|---|---|---|---|---|
| 8,948,406 | B2 * | 2/2015 | Lee et al. | 381/22 |
| 2006/0080701 | A1 * | 4/2006 | Yueh et al. | 725/28 |
| 2011/0022402 | A1 | 1/2011 | Engdegard et al. | |

FOREIGN PATENT DOCUMENTS

| | | | |
|---|---|---|---|
| KR | 1020060060927 | A | 6/2006 |
| KR | 1020100138716 | A | 12/2010 |
| KR | 1020110044693 | A | 4/2011 |
| WO | 2010040456 | A1 | 4/2010 |

* cited by examiner

*Primary Examiner* — Charlotte M Baker
(74) *Attorney, Agent, or Firm* — William Park & Associates Ltd.

(57) ABSTRACT

Provided is an apparatus and method for converting a 10.2 channel signal into a multi-channel signal having a relatively few number of channels, thereby encoding and decoding the 10.2 channel signal. An apparatus for encoding/decoding a multi-channel signal may include a multi-channel signal converter to convert a first multi-channel signal into a second multi-channel signal having a fewer number of channels when compared to the first multi-channel signal, a remaining signal generator to generate a remaining signal using a difference between the first multi-channel signal and the second multi-channel signal, and an encoder to encode the second multi-channel signal and the remaining signal.

16 Claims, 9 Drawing Sheets

DEVICE AND METHOD FOR ENCODING AND DECODING MULTICHANNEL SIGNAL

TECHNICAL FIELD

The present invention relates to an apparatus and method for encoding and decoding a multi-channel signal, more particular, to an apparatus and method for encoding and decoding a multi-channel signal that converts a 10.2 channel signal into a multi-channel signal having a relatively few number of channels, thereby encoding and decoding the 10.2 channel signal.

BACKGROUND ART

Nowadays, with development in a wave field synthesis (WFS) technology corresponding to a technology for reproducing an audio based on a loudspeaker array environment, a multi-channel audio reproducing system having a greater number of channels such as a 22.2 channel signal and a 10.2 channel signal when compared to a conventional 5.1 channel signal, and 7.1 channel signal is being developed.

However, since an amount of information may increase as a number of channels increases, a conventional apparatus for encoding and decoding the 5.1 channel signal or the 7.1 channel signal may not encode or decode the 22.2 channel signal and the 10.2 channel signal and thus, a signal generated using the 22.2 channel signal and the 10.2 channel signal may have a limited compatibility with a conventional system for reproducing a multi-channel audio.

Accordingly, there is a desire for a method of encoding or decoding the 22.2 channel signal and the 10.2 channel signal using a conventional apparatus for encoding and decoding the 5.1 channel signal or the 7.1 channel signal so that a signal of the 22.2 channel signal and the 10.2 channel signal may be compatible.

DISCLOSURE OF INVENTION

Technical Goals

An aspect of the present invention provides an apparatus and method for encoding and decoding, using a conventional encoder and decoder, a multi-channel signal having a greater number of channels when compared to a conventional multi-channel signal.

Another aspect of the present invention provides an apparatus and method for preventing an error that occurs when restoring a multi-channel signal having a relatively great number of channels from a multi-channel signal having a relatively few number of channels.

Technical Solutions

According to an aspect of the present invention, there is provided an apparatus for encoding a multi-channel signal, the apparatus including a multi-channel signal converter to convert a first multi-channel signal into a second multi-channel signal having a fewer number of channels when compared to the first multi-channel signal, a remaining signal generator to generate a remaining signal using a difference between the first multi-channel signal and the second multi-channel signal, and an encoder to encode the second multi-channel signal and the remaining signal.

According to another aspect of the present invention, there is provided an apparatus for decoding a multi-channel signal, the apparatus including a signal extracting unit to extract, from a received signal, an encoded second multi-channel signal and an encoded remaining signal, a decoder to restore the second multi-channel signal and the remaining signal by decoding the encoded second multi-channel signal and the remaining signal, and a multi-channel signal converter to convert, using the remaining signal, the second multi-channel signal into a first multi-channel signal.

According to still another aspect of the present invention, there is provided an apparatus for encoding a multi-channel signal, the apparatus including an encoder to encode a 10.2 channel signal, and a signal outputting unit to output, as a single signal, the encoded 10.2 channel signal and a downmixing matrix.

According to yet another aspect of the present invention, there is provided an apparatus for decoding a multi-channel signal, the apparatus including a signal separator to separate an encoded 10.2 channel signal and a downmixing matrix from a received signal, a decoder to decode a 10.2 channel signal by decoding the encoded 10.2 channel signal, and a downmixing unit to downmix, using a downmixing matrix, the 10.2 channel signal.

According to a further aspect of the present invention, there is provided a method of encoding a multi-channel signal, the method including converting a first multi-channel signal into a second multi-channel signal having a fewer number of channels when compared to the first multi-channel signal, generating a remaining signal using a difference between the first multi-channel signal and the second multi-channel signal, and encoding the second multi-channel signal and the remaining signal.

According to another aspect of the present invention, there is provided a method of decoding a multi-channel signal, the method including extracting, from a received signal, an encoded second multi-channel signal and an encoded remaining signal, restoring the second multi-channel signal and the remaining signal by decoding the encoded second multi-channel signal and the remaining signal, and converting, using the remaining signal, the second multi-channel signal into a first multi-channel signal.

Effect of the Invention

According to an aspect of the present invention, it is possible to encode and decode, using a conventional encoder and decoder, a multi-channel signal having a relatively great number of channels by converting the multi-channel signal having a relatively great number of channels into a conventional multi-channel signal having a relatively few number of channels, transmitting the converted multi-channel signal, and restoring the original multi-channel signal in a restoring process.

According to another aspect of the present invention, it is possible to prevent an error due to a conversion of a multi-channel signal by generating a remaining signal using a difference value between channel signals when converting a multi-channel signal having a relatively great number of channels into a multi-channel signal having a relatively few number of channels, and by utilizing the remaining signal when restoring the converted multi-signal channel signal to the original multi-channel signal.

BEST MODE FOR CARRYING OUT THE INVENTION

Figure 1:
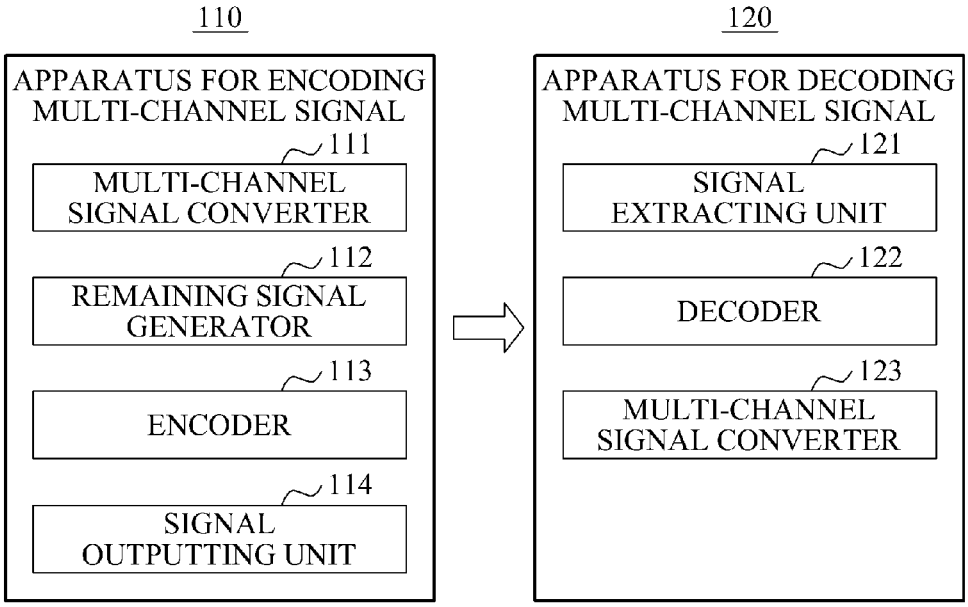
FIG. 1 is a block diagram illustrating an apparatus for encoding a multi-channel signal and an apparatus for decoding a multi-channel signal according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a block diagram illustrating an apparatus for encoding a multi-channel signal and an apparatus for decoding a multi-channel signal according to an embodiment of the present invention.

An apparatus for encoding a multi-channel signal 110 and an apparatus for decoding a multi-channel signal 120 according to an embodiment of the present invention may encode, transmit, decode, and output a 10.2 channel signal by employing a conventional 5.1 channel signal encoder/decoder or a conventional 7.1 channel signal encoder/decoder.

Referring to FIG. 1, the apparatus for encoding a multi-channel signal 110 according to an embodiment of the present invention may include a multi-channel signal converter 111, a remaining signal generator 112, an encoder 113, and a signal outputting unit 114.

The multi-channel signal converter 111 may convert a first multi-channel signal into a second multi-channel signal having a fewer number of channels when compared to the first multi-channel signal. For example, the multi-channel signal converter 111 may convert, using a downmixing matrix of the first multi-channel signal as illustrated in Table 1, a 10.2 channel signal into a 5.1 channel signal, a 7.1 channel signal, or a 2.0 channel signal. In this instance, the 10.2 channel signal may correspond to a signal having channels disposed in a form illustrated in FIG. 2.

TABLE 1

| Down-Mix Layout | Channel matrixing |
|---|---|
| 10.2 → 7.1 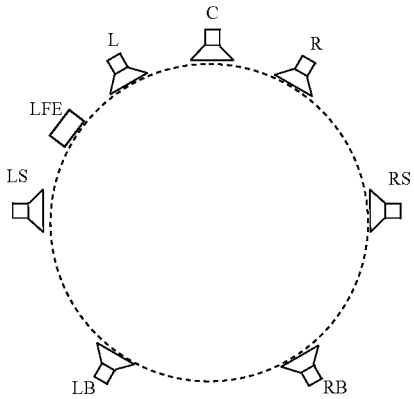  | $L = a * L + c * LH$<br>$R = a * R + c * RH$<br>$C = a * C$<br>$LS = a * LS$<br>$RS = a * RS$<br>$LB = a * LB + c * \frac{1}{\sqrt{2}} CH$<br>$RB = a * RB + c * \frac{1}{\sqrt{2}} CH$<br>$LFE = k * LFE1 + l * LFE2$ |

TABLE 1-continued

| Down-Mix Layout | Channel matrixing |
|---|---|
| 10.2 → 5.1 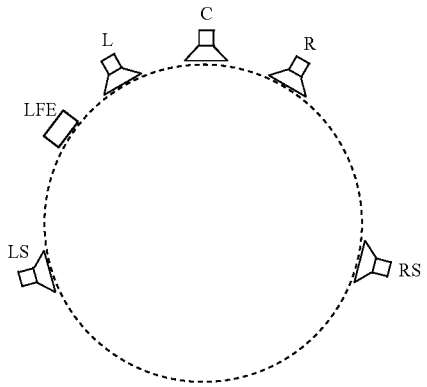  | $L = a * L + c * LH$<br>$R = a * R + c * RH$<br>$C = a * C$<br>$LS = a*(LB + LS) + c*\frac{1}{\sqrt{2}}CH$<br>$RS = a*(RB + RS) + c*\frac{1}{\sqrt{2}}CH$<br>$LFE = k * LFE1 + l * LFE2$ |
| 10.2 → 2.0 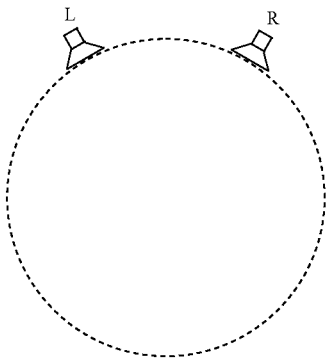  | $L = a*\left(L + \frac{1}{\sqrt{2}}C + \frac{1}{\sqrt{2}}LB + \frac{1}{\sqrt{2}}LS\right) + c*\left(LH + \frac{1}{2}CH\right)$<br>$R = a*\left(R + \frac{1}{\sqrt{2}}C + \frac{1}{\sqrt{2}}RB + \frac{1}{\sqrt{2}}RS\right) + c*\left(RH + \frac{1}{2}CH\right)$ |

The remaining signal generator 112 may generate a remaining signal using a difference between the first multi-channel signal and the second multi-channel signal. The 10.2 channel signal may have a greater number of channels and thus, may include a larger amount of information when compared to the 5.1 channel signal, the 7.1 channel signal, or the 2.0 channel signal. That is, information loss may occur when the 10.2 channel signal is converted into the 5.1 channel signal, the 7.1 channel signal, or the 2.0 channel signal. In this instance, the remaining signal generator 112 may generate a remaining signal using information, among pieces of information included in the 10.2 channel signal, excluded from a channel signal converted by the multi-channel signal converter 111.

For example, when the second multi-channel signal corresponds to the 5.1 channel signal, the remaining signal generator 112 may generate a remaining signal using Table 2.

TABLE 2

| 5.1 | Remaining signal |
|---|---|
| $L' = a * L + c * LH$<br>$R' = a * R + c * RH$<br>$C' = a * C$ | $L'' = L - L'$<br>$= (1 - a)*L - c*CH$ |
| $LS' = a*(LB + LS) + c*\frac{1}{\sqrt{2}}CH$ | $R'' = R - R'$<br>$= (1 - a)*R - c*RH$ |
| | $C'' = C - C'$<br>$= (1 - a)*C$ |
| $RS' = a*(RB + RS) + c*\frac{1}{\sqrt{2}}CH$ | $LS'' = LB - LS'$<br>$= (1 - a)*LB - a*LS - c*\frac{1}{\sqrt{2}}CH$ |

TABLE 2-continued

| 5.1 | Remaining signal |
|---|---|
| LFE' = k * LFE1 + l * LFE2 | $LS''' = LS - LS' = -a*LB + (1-a)*LS - c*\frac{1}{\sqrt{2}}CH$ |
| | $RS'' = RB - RS' = (1-a)*RB - a*RS - c*\frac{1}{\sqrt{2}}CH$ |
| | $RS''' = RS - RS' = -a*RB + (1-a)*RS - c*\frac{1}{\sqrt{2}}CH$ |
| | $LFE'' = LFE - LFE' = (1-k)*LFE1 - l*LFE2$ |

Figure 2:
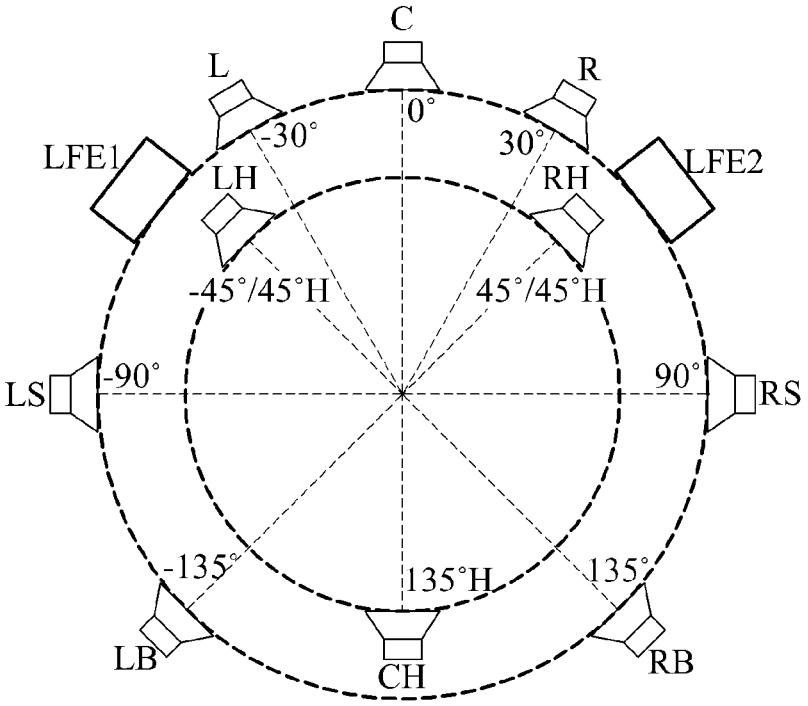
FIG. 2 is a diagram illustrating an example of a 10.2 channel signal according to an embodiment of the present invention.

In this example, L, LH, R, RH, C, LB, LS, CH, RB, RS, LFE1, and LFE2 may correspond to values of channels included in the first multi-channel signal when the first multi-channel signal corresponds to the 10.2 channel signal illustrated in FIG. 2.

Here, the remaining signal may correspond to a channel of the second multi-channel signal, and may correspond to a multi-channel signal including a greater number of channels when compared to the second multi-channel signal. In particular, when a channel of the second multi-channel signal corresponds to a channel converted using channels of the first multi-channel signal and multiplied by the same constant, the remaining signal generator 112 may generate, using a difference between the first multi-channel signal and the second multi-channel signal, a plurality of remaining signals corresponding to a channel of the second multi-channel signal. For example, the remaining signal generator 112 may generate remaining signals for an LS' channel of the 5.1 channel signal converted by multiplying the same constant "a" by an LB channel and an LS channel of the 10.2 channel signal. Here, an LS" channel and an LS''' channel of the remaining signals corresponding to the LS' channel may be generated using a difference between each of the LB channel, and the LS channel, and the LS' channel, respectively.

That is, the remaining signals may further include the LS''' channel and an RS''' channel for preventing an error when restoring the 10.2 channel from the 5.1 channel and thus, a number of channels may increase when compared to the second multi-channel signal.

The encoder 113 may encode each of the second multi-channel signal converted by the multi-channel signal converter 111 and the remaining signal generated by the remaining signal generator 112. In this instance, the encoder 113 may encode, using a conventional 5.1 channel encoder, the second multi-channel signal corresponding to the 5.1 channel signal. Further, since the remaining signal may correspond to a 7.1 channel signal, obtained by adding two channels corresponding to additional information to a 5.1 channel, the encoder 113 may encode the remaining signal using a conventional 7.1 channel signal encoder.

The signal outputting unit 114 may output, as a transmission signal corresponding to a single signal, a downmixing matrix of the first multi-channel signal, the second multi-channel signal encoded by the encoder 113, the remaining signal encoded by the encoder 113. In this instance, the signal outputting unit 114 may store the transmission signal, or transmit the transmission signal to the apparatus for decoding a multi-channel signal 120. Here, the signal outputting unit 114 may correspond to a multiplexer (MUX) that outputs a plurality of signals as a single signal.

In this instance, the downmixing matrix corresponding to information associated with an operation of converting the first multi-channel signal into the second multi-channel signal. For example, the downmixing matrix corresponding to a downmixing matrix associated with an operation of converting the 10.2 channel signal into the 2.0 channel signal, and an operation of converting the 10.2 channel signal into the 7.1 channel signal.

Referring to FIG. 1, the apparatus for decoding a multi-channel signal 120 according to an embodiment of the present invention a signal extracting unit 121, a decoder 122, and a multi-channel signal converter 123.

The signal extracting unit 121 may extract, from a transmission signal received from the apparatus for encoding a multi-channel signal 110, an encoded second multi-channel signal, an encoded remaining signal, and a downmixing matrix. In this instance, the signal extracting unit 121 may correspond to a demultiplexer (DEMUX) that receives a single signal and outputs a plurality of signals.

The decoder 122 may receive, from the signal extracting unit 121, the encoded second multi-channel signal and the encoded remaining signal, and restore the second multi-channel signal and the remaining signal by decoding the received signals.

In this instance, the decoder 122 may decode, using a conventional 5.1 channel signal decoder, the second multi-channel signal corresponding to the 5.1 channel signal. Further, the decoder 122 may decode the remaining signal using a conventional 7.1 channel signal decoder.

The multi-channel signal converter 123 may covert, using the remaining signal, the second multi-channel signal into the first multi-channel signal.

For example, the multi-channel signal converter 123 may restore L, LH, R, RH, C, LB, LS, CH, RB, RS, LFE1, and LFE2 corresponding to channels of the first multi-channel signal, for example, the 10.2 channel signal by utilizing L', R', C', LS', RS', and LFE' channels of the second multi-channel signal and L", R", C", LS", LS''', RS", RS", and LFE" channels of the remaining signal as illustrated in Table 3.

TABLE 3

| 10.2 |
|---|
| $L = L' + L''$ |
| $R = R' + R''$ |
| $C = C' + C''$ |
| $LB = LS' + LS''$ |
| $LS = LS' + LS'''$ |
| $RB = RS' + RS''$ |
| $RS = RS' + RS'''$ |
| $LFE1 = LFE' + LFE''$ |
| $CH = \sqrt{2} * \frac{LS' - a*(LS' + LS'' + LS' + LS''')}{c}$ |
| $LH = \frac{L' - a*(L' + L'')}{c}$ |
| $RH = \frac{R' - a*(R' + R'')}{c}$ |
| $LFE2 = \frac{LFE' - k*LFE''}{l}$ |

In this instance, the multi-channel signal converter 123 may convert, using a downmixing matrix, the first multi-channel signal into a third multi-channel signal. Further, the multi-channel signal converter 123 may convert, using a downmixing matrix, the second multi-channel signal into a third multi-channel signal.

In this instance, the third multi-channel signal may correspond to a multi-channel signal, among multi-channel signals having a fewer number of channels when compared to the first multi-channel signal, other than the second multi-channel signal.

For example, the multi-channel signal converter 123 may covert, using Table 4, the second multi-channel signal, for example, the 5.1 channel signal into the third multi-channel signal, for example, the 2.0 channel signal.

TABLE 4

| 5.1 → 2.0 |
|---|
| $L = \left(1 + \frac{c}{a} - c\right)*L - c*LH + \frac{1}{\sqrt{2}}*C + \left(\frac{1}{\sqrt{2}} - \frac{a}{\sqrt{2}} + \frac{a^2}{\sqrt{2}} + \frac{\sqrt{2}}{2} - \frac{a\sqrt{2}}{2}\right)* LS + \left(\frac{a^2}{\sqrt{2}} - \frac{a\sqrt{2}}{2}\right)* LB + \frac{c}{2}*(a-1)*CH$ |
| $R = \left(1 + \frac{c}{a} - c\right)*R - c*RH + \frac{1}{\sqrt{2}}*C + \left(\frac{1}{\sqrt{2}} - \frac{a}{\sqrt{2}} + \frac{a^2}{\sqrt{2}} + \frac{\sqrt{2}}{2} - \frac{a\sqrt{2}}{2}\right)* RS + \left(\frac{a^2}{\sqrt{2}} - \frac{a\sqrt{2}}{2}\right)* RB + \frac{c}{2}*(a-1)*CH$ |

That is, an apparatus for encoding a multi-channel signal and an apparatus for decoding a multi-channel signal according to an embodiment of the present invention may encode and decode, using a conventional encoder and decoder, a multi-channel signal having a relatively great number of channels by converting the multi-channel signal having a relatively great number of channels into a conventional multi-channel signal having a relatively few number of channels, transmitting the converted multi-channel signal, and restoring the original multi-channel signal in a restoring process.

According to embodiments of the present invention, it is possible to prevent an error due to a conversion of a multi-channel signal by generating a remaining signal using a difference between channel signals when converting a multi-channel signal having a relatively great number of channels into a multi-channel signal having a relatively few number of channels, and by utilizing the remaining signal when restoring the converted multi-channel signal to the original multi-channel signal.

Figure 3:
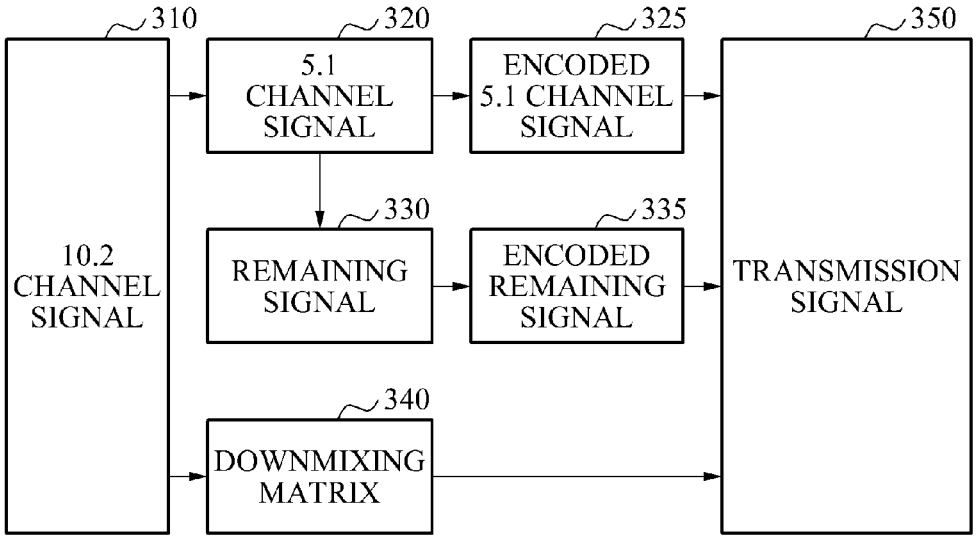
FIG. 3 is a diagram illustrating an example of an encoding operation performed by an apparatus for encoding a multi-channel signal according to an embodiment of the present invention.

FIG. 3 is a diagram illustrating an example of an encoding operation performed by the apparatus for encoding a multi-channel signal 110 according to an embodiment of the present invention.

The multi-channel signal converter 111 may convert a 10.2 channel signal 310 into a 5.1 channel signal 320.

Subsequently, the remaining signal generator 112 may generate a remaining signal 330 using a difference between the 10.2 channel signal 310 and the 5.1 channel signal 320.

Then, the encoder 113 may generate an encoded 5.1 channel signal 325 and an encoded remaining signal 335 by encoding the 5.1 channel signal 320 and the remaining signal 330, respectively.

The signal outputting unit 114 may output, as a transmission signal 350 corresponding to a single signal, a downmixing matrix 340 of the 10.2 channel signal 310, the encoded 5.1 channel signal 325, and the encoded remaining signal 335.

Figure 4:
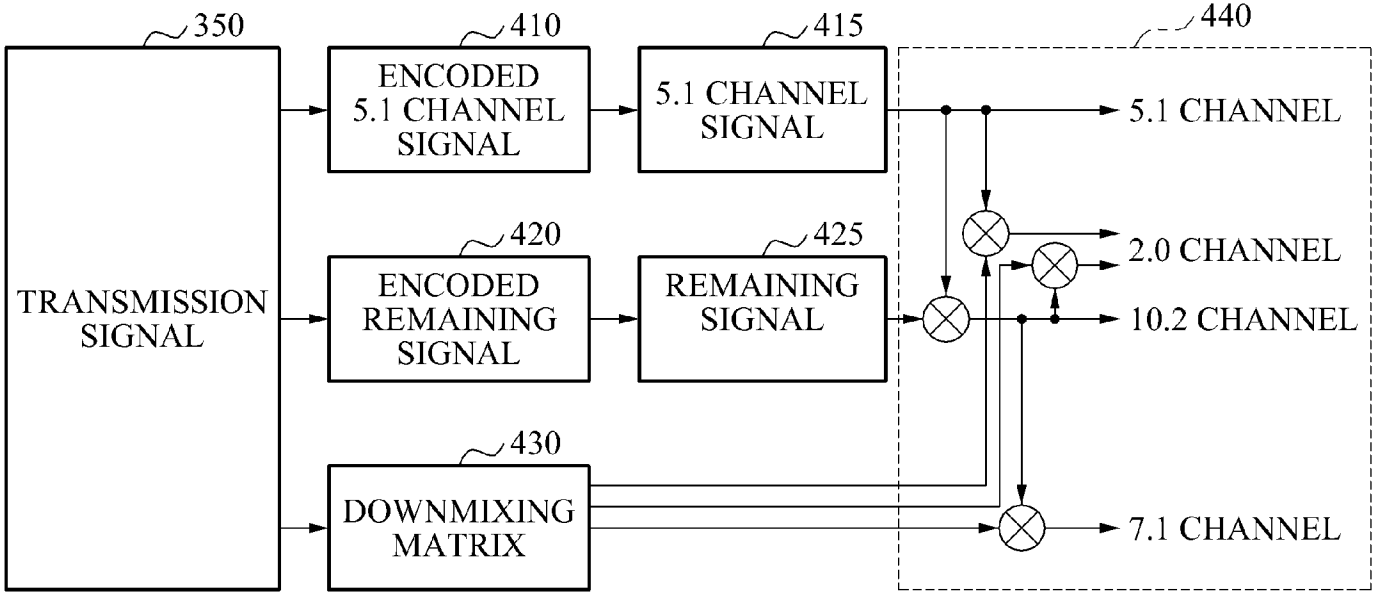
FIG. 4 is a diagram illustrating an example of a decoding operation performed by an apparatus for decoding a multi-channel signal according to an embodiment of the present invention.

FIG. 4 is a diagram illustrating an example of a decoding operation performed by the apparatus for decoding a multi-channel signal 120 according to an embodiment of the present invention.

The signal extracting unit 121 may extract an encoded 5.1 channel signal 410, an encoded remaining signal 420, and a downmixing matrix 430 from a transmission signal 350 received from the apparatus for encoding a multi-channel signal 110.

Subsequently, the decoder 122 may restore a 5.1 channel signal 415 by decoding the encoded 5.1 channel signal 410, and restore a remaining signal 425 by decoding the encoded remaining signal 420.

The multi-channel signal converter 123 may convert, using the remaining signal 425 and the downmixing matrix 430, the 5.1 channel signal 415 into various multi-channel signals 440, and output the converted multi-channel signals 440 to an output device.

For example, the multi-channel signal converter 123 may output the 5.1 channel signal 415 as is, and may output the 5.1 channel signal 415 converted into a 10.2 channel signal through being combined with the remaining signal 425.

The multi-channel signal converter 123 may convert the 5.1 channel signal 415 into a 2.0 channel signal by applying the downmixing matrix 430, or may convert a 10.2 channel signal, converted by combining the remaining signal 425 with the 5.1 channel signal 415, into a 2.0 channel signal by applying the downmixing matrix 430 to the 10.2 channel signal.

The multi-channel signal converter 123 may convert a 10.2 channel signal, converted by combining the remaining signal 425 with the 5.1 channel signal 415, into a 7.1 channel signal by applying the downmixing matrix 430 to the 10.2 channel signal.

Figure 5:
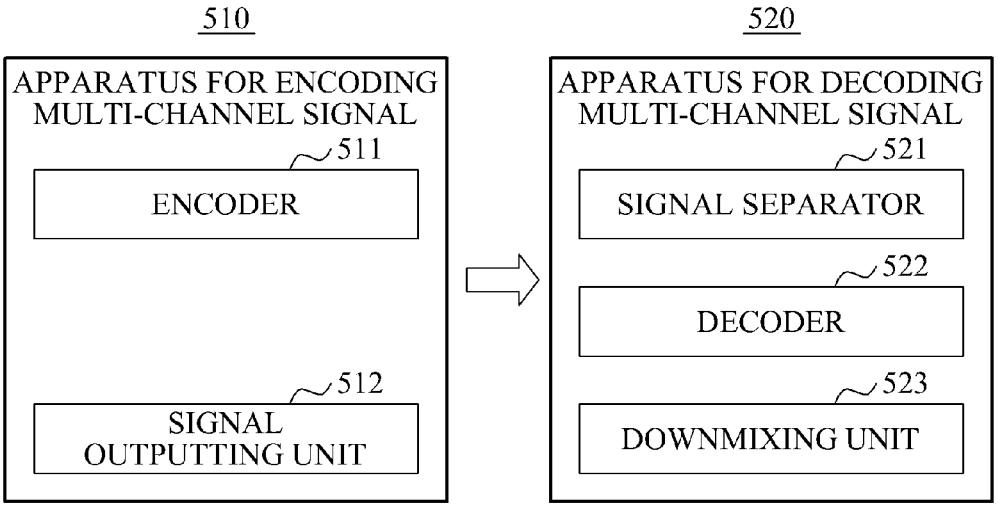
FIG. 5 is a block diagram illustrating an apparatus for encoding a multi-channel signal and an apparatus for decoding a multi-channel signal according to another embodiment of the present invention.

FIG. 5 is a block diagram illustrating an apparatus for encoding a multi-channel signal and an apparatus for decoding a multi-channel signal according to another embodiment of the present invention.

FIG. 5 illustrates an apparatus for encoding a multi-channel signal 510 that includes a 10.2 channel signal encoder and an apparatus for decoding a multi-channel signal 520 that includes a 10.2 channel signal decoder. In this instance, since the apparatus for encoding a multi-channel signal 510 and the apparatus for decoding a multi-channel signal 520 may encode and decode a 10.2 channel signal may be similar to that outlined in the foregoing, a configuration of converting a 10.2 channel signal into a conventional channel signal such as a 5.1 channel signal, or generating a remaining signal may be omitted for conciseness.

Referring to FIG. 5, the apparatus for encoding a multi-channel signal 510 according to another embodiment of the present invention may include an encoder 511 and a signal outputting unit 512.

The encoder 511 may correspond to an encoder of the 10.2 channel signal.

In this instance, the signal outputting unit 512 may output, as a transmission signal corresponding to a single signal, a downmixing matrix of a 10.2 channel signal and a 10.2 channel signal encoded by the encoder 511. The signal outputting unit 512 may store or transmit the transmission signal to the apparatus for decoding a multi-channel signal 120. The signal outputting unit 512 may correspond to a MUX that that outputs a plurality of signals as a single signal.

Referring to FIG. 5, the apparatus for decoding a multi-channel signal 520 according to another embodiment of the present invention may include a signal separator 521, a decoder 522, and a downmixing unit 523.

The signal separator 521 may extract an encoded 10.2 channel signal and a downmixing matrix from the transmission signal received from the apparatus for encoding a multi-channel signal 510. In this instance, the signal extracting unit 121 may correspond to a DEMUX that receives a single signal and outputs a plurality of signals.

The decoder 522 may receive the encoded 10.2 channel signal from the signal separator 521, decode the received encoded 10.2 channel signal, and restore the 10.2 channel signal. In this instance, the decoder 522 may correspond to a 10.2 channel signal decoder.

The downmixing unit 523 may downmix, using a downmixing matrix extracted by the signal separator 521, the 10.2 channel signal. In this instance, the mixing matrix extracted by the signal separator 521 may correspond to Table 1.

Figure 6:
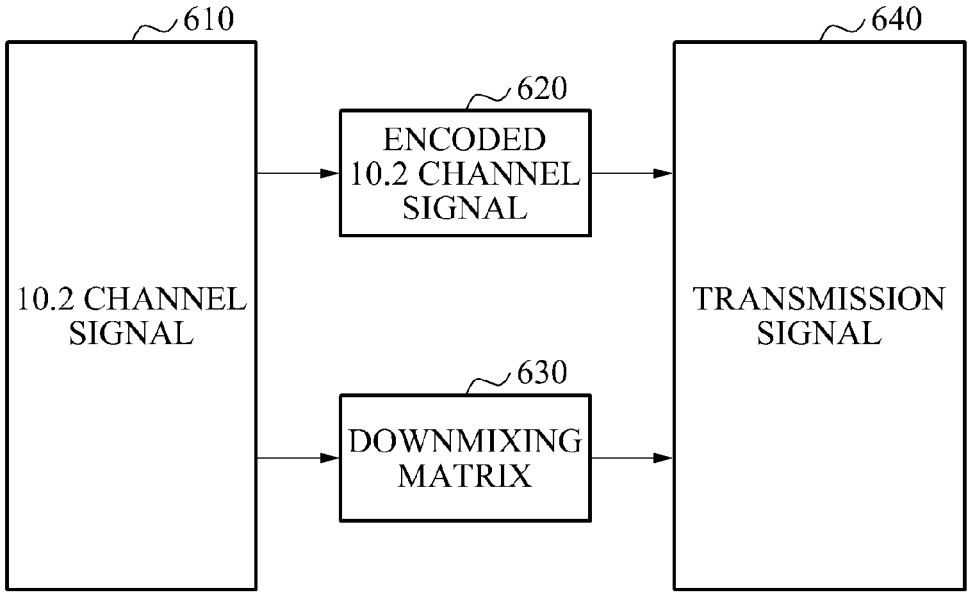
FIG. 6 is a diagram illustrating an example of an encoding operation performed by an apparatus for encoding a multi-channel signal according to another embodiment of the present invention.

FIG. 6 is a diagram illustrating an example of an encoding operation performed by the apparatus for encoding a multi-channel signal 510 according to another embodiment of the present invention.

The encoder 511 may encode a 10.2 channel signal 610 to generate an encoded 10.2 channel signal 620.

Subsequently, the signal outputting unit 512 may output, as a transmission signal 640 corresponding to a single signal, a downmixing matrix 630 of the 10.2 channel signal 610 and the encoded 10.2 channel signal 620.

That is, since the encoder 511 may encode a 10.2 channel signal, the apparatus for encoding a multi-channel signal 510 according to another embodiment of the present invention may omit an operation of converting a 10.2 channel signal into a conventional channel signal such as a 5.1 channel signal, and generating a remaining signal to prevent information from being lost due to a converting operation.

Figure 7:
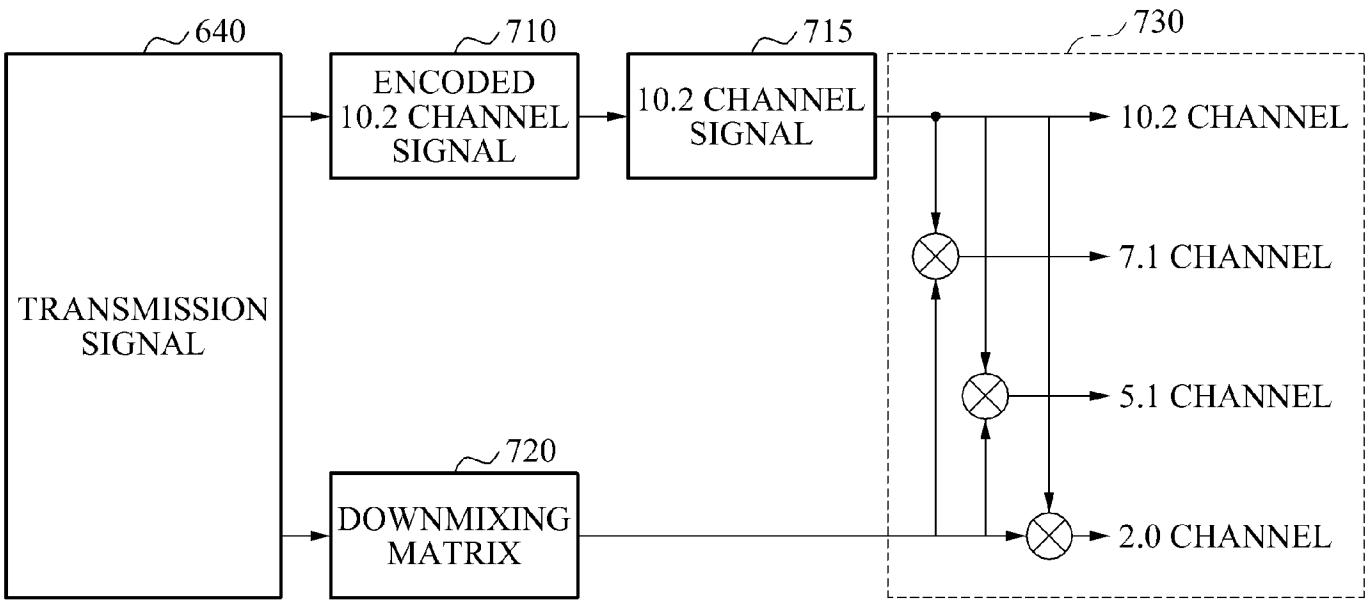
FIG. 7 is a diagram illustrating an example of a decoding operation performed by an apparatus for decoding a multi-channel signal according to another embodiment of the present invention.

FIG. 7 is a diagram illustrating an example of a decoding operation performed by the apparatus for decoding a multi-channel signal 520 according to another embodiment of the present invention.

The signal separator 521 may extract an encoded 10.2 channel signal 710 and a downmixing matrix 720 from a transmission signal 640 received from the apparatus for encoding a multi-channel signal 510.

Subsequently, the decoder 522 may restore a 10.2 channel signal 715 by decoding the encoded 10.2 channel signal 710.

The downmixing unit 523 may downmix, using the downmixing matrix 720, the 10.2 channel signal 715 to various multi-channel signals 730, and output the downmixed multi-channel signals 730 to an output device.

For example, the downmixing unit 523 may output the 10.2 channel signal 715 as is, and may downmix the 10.2 channel signal 715 to one of a 7.1 channel signal, a 5.1 channel signal, and a 2.0 channel signal by applying the downmixing matrix 720.

Figure 8:
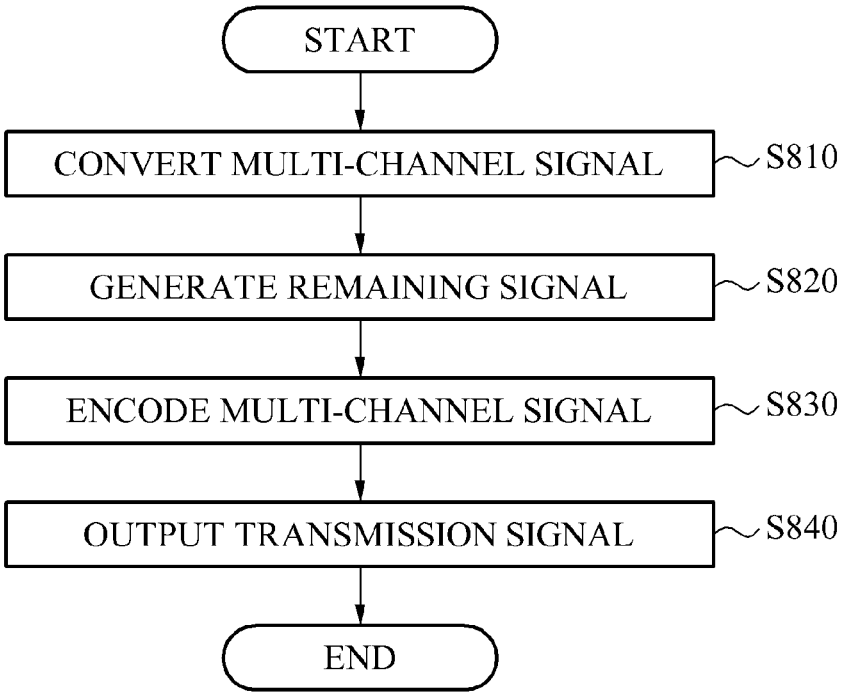
FIG. 8 is a flowchart illustrating a method of encoding a multi-channel signal according to an embodiment of the present invention.

FIG. 8 is a flowchart illustrating a method of encoding a multi-channel signal according to an embodiment of the present invention.

In operation S810, the multi-channel signal converter 111 may convert a first multi-channel signal into a second multi-channel signal.

In operation S820, the remaining signal generator 112 may generate a remaining signal using a difference between the first multi-channel signal and the second multi-channel signal converted in operation S810.

In operation S830, the encoder 113 may generate an encoded second multi-channel signal and an encoded remaining signal by encoding each of the second multi-channel signal converted in operation S810 and the remaining signal generated in operation S820.

In operation S840, the signal outputting unit 114 may output, as a transmission signal corresponding to a single signal, a downmixing matrix of the first multi-channel signal, the second multi-channel signal encoded in operation S830, and the remaining signal encoded in operation S830.

Figure 9:
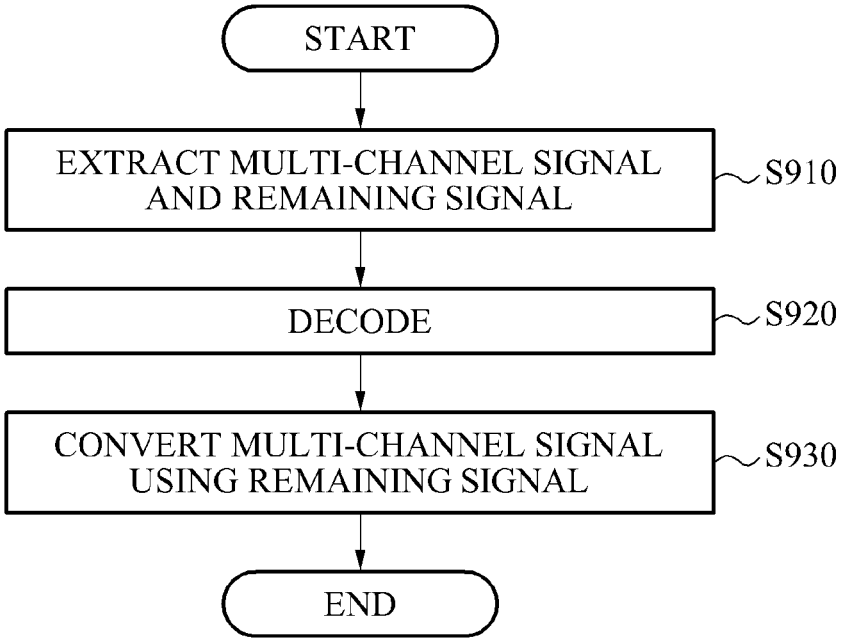
FIG. 9 is a flowchart illustrating a method of decoding a multi-channel signal according to an embodiment of the present invention.

FIG. 9 is a flowchart illustrating a method of decoding a multi-channel signal according to an embodiment of the present invention.

In operation S910, the signal extracting unit 121 may extract, from the transmission signal 350 received from the apparatus for encoding a multi-channel signal 110, an encoded second multi-channel signal, an encoded remaining signal, and a downmixing matrix.

In operation S920, the decoder 122 may restore the second multi-channel signal and the remaining signal by decoding the signals extracted in operation S910.

In operation S930, the multi-channel signal converter 123 may convert, using the remaining signal restored in operation S920 and the downmixing matrix extracted in operation S910, the second multi-channel signal restored in operation S920 into various multi-channel signals.

The present invention may encode and decode, using a conventional encoder and decoder, a multi-channel signal having a relatively great number of channels by converting the multi-channel signal having a relatively great number of channels into a conventional multi-channel signal having a relatively few number of channels, transmitting and restoring the original multi-channel signal in a restoring process.

According to an embodiment of the present invention, it is possible to prevent an error due to a conversion of a multi-channel signal by generating a remaining signal using a difference value between channels signals when converting a multi-channel signal having a relatively great number of channels into a multi-channel signal having a relatively few number of channels, and by utilizing the remaining signal when restoring the converted multi-channel signal to the original multi-channel signal.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

It is to be understood that both the foregoing general description and the following detailed description are exemplary and explanatory and are intended to provide further explanation of the invention as claimed.

The invention claimed is:

1. An apparatus for encoding a multi-channel signal, the apparatus comprising:

a multi-channel signal converter to convert a first multi-channel signal into a second multi-channel signal having a fewer number of channels when compared to the first multi-channel signal;

a remaining signal generator to generate a remaining signal using a difference between the first multi-channel signal and the second multi-channel signal; and an encoder to encode the second multi-channel signal and the remaining signal.

2. The apparatus of claim 1, wherein the remaining signal corresponds to a channel of the second multi-channel signal, and corresponds to a multi-channel signal including a greater number of channels when compared to the second multi-channel signal.

3. The apparatus of claim 1, wherein, when a channel of the second multi-channel signal corresponds to a channel converted using channels of the first multi-channel signal multiplied by the same constant, the remaining signal generator generates, using a difference between the first multi-channel signal and the second multi-channel signal, a plurality of remaining signals corresponding to a channel of the second multi-channel signal.

4. The apparatus of claim 1, further comprising:

a signal outputter to output, as a single signal, an encoded second multi-channel signal, an encoded remaining signal, and a downmixing matrix of the first multi-channel signal.

5. The apparatus of claim 4, wherein the downmixing matrix corresponds to information associated with an operation of converting the first multi-channel signal into the second multi-channel signal.

6. An apparatus for decoding a multi-channel signal, the apparatus comprising:

a signal extractor to extract from a received signal, an encoded second multi-channel signal and an encoded remaining signal;

a decoder to restore the second multi-channel signal and the remaining signal by decoding the encoded second multi-channel signal and the remaining signal; and a multi-channel signal converter to convert, using the remaining signal, the second multi-channel signal into a first multi-channel signal.

7. The apparatus of claim 6, wherein the multi-channel signal converter converts, using a downmixing matrix, the first multi-channel signal into a third multi-channel signal.

8. The apparatus of claim 6, wherein the multi-channel signal converter converts, using a downmixing matrix, the second multi-channel signal into a third multi-channel signal.

9. A method of decoding a multi-channel signal, the method comprising:

extracting, from a received signal, an encoded second multi-channel signal and an encoded remaining signal;

restoring the second multi-channel signal and the remaining signal by decoding the encoded second multi-channel signal and the remaining signal; and converting, using the remaining signal, the second multi-channel signal into a first multi-channel signal.

10. The method of claim 9, further comprising:

converting, using a downmixing matrix, the first multi-channel signal into a third multi-channel signal.

11. The method of claim 9, further comprising:

converting, using a downmixing matrix, the second multi-channel signal into a third multi-channel signal.

12. A method of encoding a multi-channel signal, the method comprising:

converting a first multi-channel signal into a second multi-channel signal having a fewer number of channels when compared to the first multi-channel signal;

generating a remaining signal using a difference between the first multi-channel signal and the second multi-channel signal; and encoding the second multi-channel signal and the remaining signal.

13. The method of claim 12, wherein, when a channel of the second multi-channel signal corresponds to a channel converted using channels of the first multi-channel signal multiplied by the same constant, the generating comprises generating, using a difference between the first multi-channel signal and the second multi-channel signal, a plurality of remaining signals corresponding to a channel of the second multi-channel signal.

14. The method of claim 12, further comprising:

outputting, as a single signal, an encoded second multi-channel signal, an encoded remaining signal, and a downmixing matrix of the first multi-channel signal.

15. The method of claim 14, wherein the downmixing matrix corresponds to information associated with an operation of converting the first multi-channel signal into the second multi-channel signal.

16. The method of claim 12, wherein the remaining signal corresponds to a channel of the second multi-channel signal, and corresponds to a multi-channel signal including a greater number of channels when compared to the second multi-channel signal.

* * * * *